US005181333A

United States Patent [19]

Gilbert

[11] Patent Number: 5,181,333

[45] Date of Patent: Jan. 26, 1993

[54] HEIGHT ADJUSTABLE PANTS PRESSER WITH TOP FINISHING

[75] Inventor: Stephen F. Gilbert, Jonesboro, Ga.

[73] Assignee: Paris Manufacturing Co., Inc., Jonesboro, Ga.

[21] Appl. No.: 738,205

[22] Filed: Jul. 30, 1991

[51] Int. Cl.[5] ..... D06F 71/28

[52] U.S. Cl. ..... 38/15; 38/27; 223/51; 223/57

[58] Field of Search ..... 38/1 A, 1 B, 12, 14, 38/15, 21, 24, 71, 27; 223/52, 52.5, 57, 66, 67, 72, 73, 51

[56] References Cited

U.S. PATENT DOCUMENTS

| | | | |
|---|---|---|---|
| 2,658,649 | 11/1953 | Rosenthal | 223/73 |
| 2,669,374 | 2/1954 | Jones | 223/57 |
| 3,415,430 | 12/1968 | McMillan | 38/21 X |
| 3,713,567 | 1/1975 | Paris | 223/73 |
| 3,883,051 | 5/1975 | Bailey | 223/51 |
| 4,371,102 | 1/1983 | Engelbart | 38/14 X |
| 4,437,246 | 3/1984 | Sanko | 223/73 X |
| 4,479,314 | 10/1984 | Frushtick | 223/73 X |
| 4,807,376 | 2/1985 | Kamata | 223/73 X |

FOREIGN PATENT DOCUMENTS

| | | | |
|---|---|---|---|
| 2402027 | 4/1979 | France | 38/21 |

*Primary Examiner*—Werner H. Schroeder
*Assistant Examiner*—Ismael Izaguirre
*Attorney, Agent, or Firm*—James B. Middleton

[57] ABSTRACT

A height adjustable pants finishing device includes a pair of topping bucks positioned in the top portion of a pair of pants to be finished. Waist clamps hold the pants in the desired orientation; then, pressing plates engage pleats to hold the pleats for pressing. Additional pressing plates engage the top portion of the pants for high quality finishing of the top of the pants. The cuffs of the pants are clamped together, and steam is injected into the pants for finishing. After steaming, heated air is passed through the pants to set the creases.

16 Claims, 4 Drawing Sheets

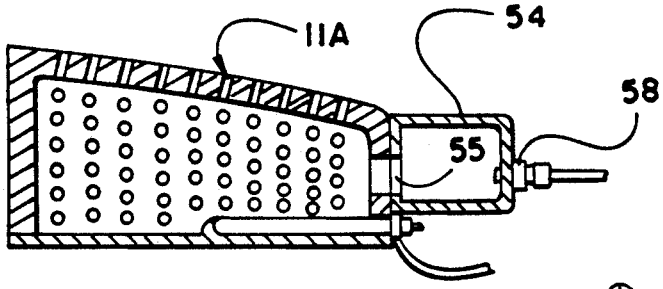
Fig. 4
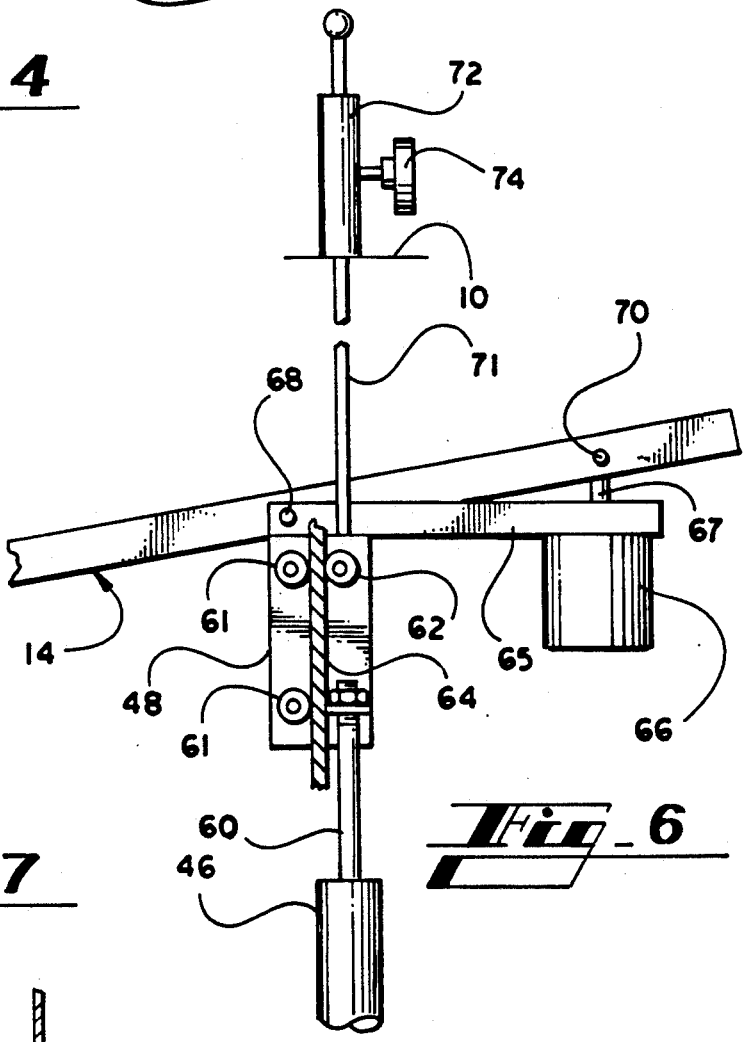
Fig. 6
Fig. 7
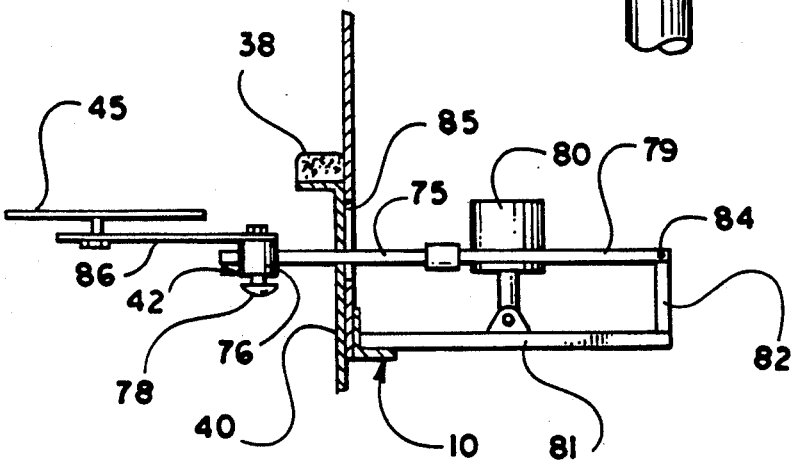

HEIGHT ADJUSTABLE PANTS PRESSER WITH TOP FINISHING

BACKGROUND OF THE INVENTION

1. Field of the Invention

This invention relates generally to finishing apparatus, and is more particularly concerned with a pants finisher having a buck type top finisher.

2. Description of the Related Art

It is well known in the cleaning and pressing art to finish casual pants by placing the pants over a form, the form generally including blades for providing creases in the pants, and a bag to be filled with steam. The arrangement is that the bag is filled with steam, and the steam passes through the bag and through the garment to press the garment. While such an apparatus is well known in the art, and is widely used, such a unit is quite limited in that little individual treatment is allowed for a pair of pants having individual styling. It is especially important that the prior art machines provide for an inadequate finishing of the upper portion of a garment, especially if the pants are pleated. For adequate finishing of pleats, a separate step has always been required which is time consuming and costly.

SUMMARY OF THE INVENTION

The present invention provides a pants finisher having creasing blades over which the garment is placed, and means for sealing the waist and the cuffs of the pants so the garment will hold steam. In conjunction with the waist sealing means, there is a waist holding means to allow the waist to be positioned accurately and retained in that position. Further, there are buck type pressing means for one or more areas of the upper portion of the pants.

In the preferred embodiment of the invention, the apparatus includes two pleat pressing means, a fly pressing means, and a rear pressing means. Additionally, there are preferably side bars that will contact approximately the pocket area of a pair of pants, the side bars being rather widely adjustable to engage an area of the pants that requires the additional pressing.

BRIEF DESCRIPTION OF THE DRAWINGS

These and other features and advantages of the present invention will become apparent from consideration of the following specification when taken in conjunction with the accompanying drawings in which:

FIG. 4 is a vertical cross-sectional view taken through one of the topping bucks and the manifold for supplying fluid to said buck;

FIG. 6 is a fragmentary view showing the position control means for the lower creasing blades;

FIG. 7 is a fragmentary view showing the construction of the side bars, and control therefor;

DETAILED DESCRIPTION OF THE EMBODIMENT

Figure 1:
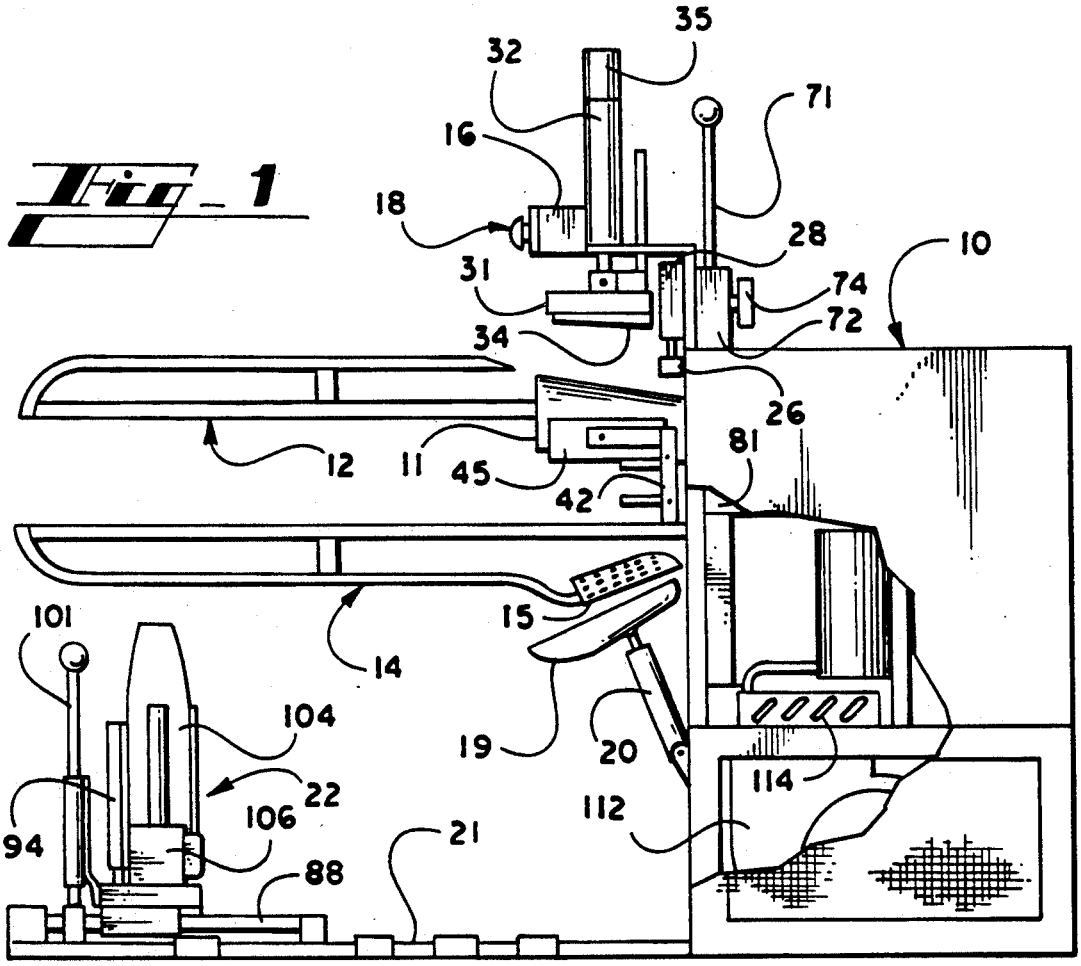
FIG. 1 is a side elevational view of a finishing apparatus made in accordance with the present invention, a portion of the cabinet being broken away to reveal the interior construction.

Referring now more particularly to the drawings, and to those embodiments of the invention here presented by way of illustration, the device as shown in FIG. 1 includes a cabinet 10, and a pair of topping bucks 11 extending therefrom. The upper creasing blades 12 extend from the topping bucks 11. Below, and parallel to, the upper blades 12, there are the lower creasing blades 14. The inner ends of the lower creasing blades 14 are connected to a rear plate 15 pivotally carried by the cabinet 10.

Fixed to the upper edge of the cabinet 10 is a plurality of air cylinders carrying pressing plates thereon. A control box 16 mounts a plurality of valves 18 for control of the various cylinders.

Below the rear plate 15, there is a rear pressing plate 19, the pressing plate 19 being controlled by a cylinder 20. When the cylinder 20 urges the plate 19 upwardly, the pressing plate substantially overlaps the rear plate 15. Thus, the rear plate 15 acts as a buck, while the pressing plate 19 acts as the top cf a buck press.

There is a member 21 extending forwardly from the cabinet 10 along the floor. At the extending end of the member 21, there is a cuff clamping assembly generally designated at 22. It will be understood that the cuff clamping assembly 22 is adjustable as will be discussed in more detail hereinafter, and is arranged to clamp the cuffs of a pair of pants around the creasing bars 12 and 14 to allow the pants to be filled with steam for pressing.

Figure 2:
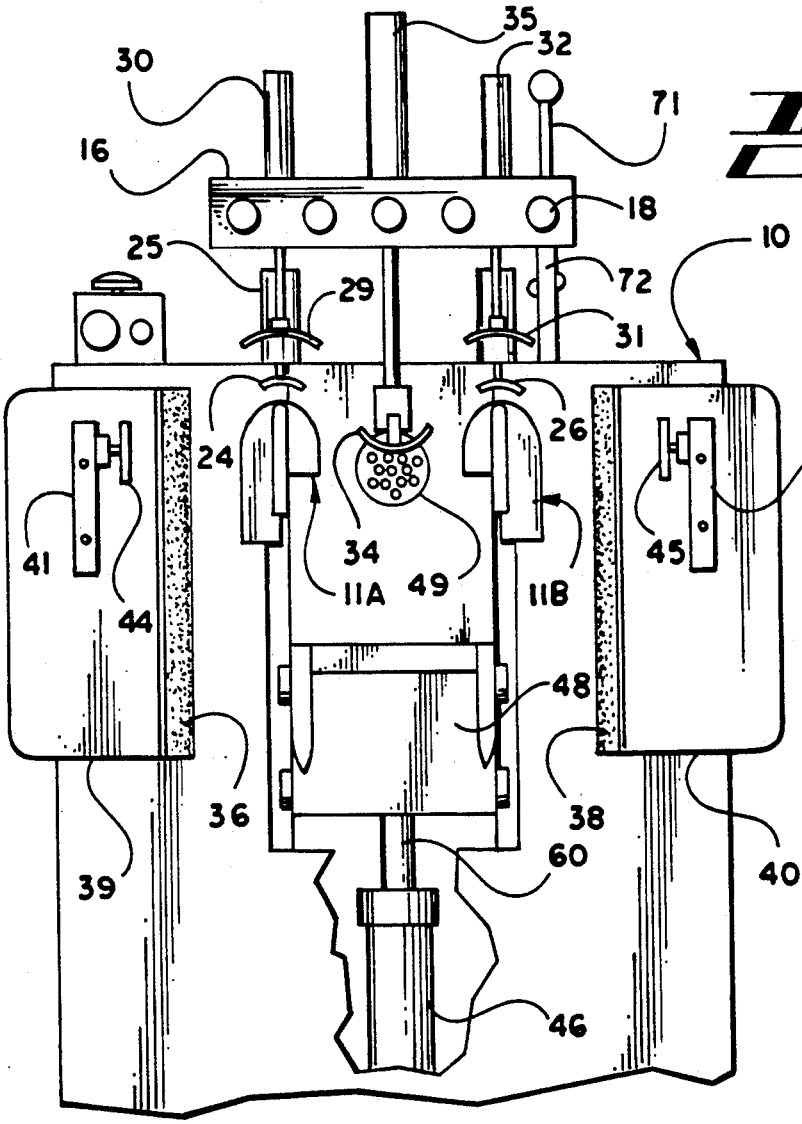
FIG. 2 is a partial front elevational view of the device illustrated in FIG. 1.

Looking at FIG. 2 in conjunction with FIG. 1, it will be seen that the topping bucks 11 include a left hand buck 11A and a right hand buck 11B, right and left being designated as viewed in FIG. 2 of the drawings. Above the left hand buck 11A, there is a left waist clamp 24 operated by a cylinder 25. Similarly, there is a right hand waist clamp 26 operated by a cylinder 28. As is better seen in FIG. 1 of the drawings, the waist clamps 24 and 26 are closely adjacent to the cabinet 10 so the clamps 24 and 26 will clamp the uppermost edge of the waistband of a pair of pants to the topping bucks 11A and 11B.

Forwardly of the waist clamps 24 and 26, or to the left as viewed in FIG. 1, there is a pleat clamp 29 operated by a cylinder 30, and a pleat clamp 31 operated by a cylinder 32. It will be seen that the pleat clamps 29 and 31 can be brought down against the bucks 11A and 11B to engage a pair of pants generally in the area where pants are pleated. It will be understood by those skilled in the art that, if pants have no pleats, the clamps 29 and 31 can still be used simply to provide a better quality finish on the upper portion of the pants, so the pleat clamps are not exclusively for pressing pleats.

Between the pleat clamps 29 and 31, there is a fly bar 34. The fly bar 34 is designed to engage the fly area of a pair of pants, and the fly bar 34 is carried on the rod of a cylinder 35.

At each side of the cabinet 10, looking at FIG. 2 of the drawings, there are waist sealing means 36 and 38, the waist sealing means being here illustrated as strips of flexible foam carried by plates 39 and 40. The plates 39 and 40 are moved with arms 41 and 42 which carry side bars 44 and 45 through a mechanism which will be described in detail hereafter, the arms 41 and 42 will move towards and away from the topping bucks 11A and 11B, carrying the plates 39 and 40 with them. Thus, when the arms 41 and 42 move inwardly, the plates 39 and 40 will move inwardly and cause the sealing means 36 and 38 to engage the waistband of a pair of pants carried by the topping bucks 11A and 11B and the creasing bars 12 and 14.

At this point it should be understood by those skilled in the art that, to utilize the device of the present invention, one will raise the clamps, or pressing plates by activating the cylinders 25 and 28 and the cylinders 30, 32 and 35. The side bars 44 and 45 will also be moved away from the topping bucks 11A and 11B. The cylinder 46 will then be activated to raise the carriage 48 sufficiently to place the lower creasing bars 14 at a height to render it easy to place a pair of pants over the upper and lower creasing bars 12 and 14. With this position, a pair of pants will be placed over the creasing bars 12 and 14, and pulled snugly against the cabinet 10, the pants having the fly and waist fastened with the usual fasteners. At this point, the pants will be manipulated to assure that the front of the pants is carefully aligned with the tops of the topping bucks 11A and 11B. If the pants are pleated, this positioning is fairly critical, and the pleat itself should be directly along the top of the bucks 11A and 11B. If the pants have no pleat, the positioning is less critical but the front area of the pants should still be appropriately placed generally along the top of the topping bucks. With the pants carefully held in alignment, the valves are operated to cause the waist clamps 24 and 26 to engage the waistband of the pants and hold the pants in position.

Assuming the pants have pleats, the next step will be to fold the pleat carefully in position to be pressed. The upper creasing bars 12 may include means to assist in this action, and that will be discussed later. Once a pleat is carefully placed on the top of a pressing buck 11A or 11B, a cylinder 30 or 32 will be activated to cause the pleat plate 29 or 31 to engage the pleat. The opposite pleat will be treated in the same manner.

With the pants generally held in position, the cylinder 46 can be activated to allow the plate 48 to drop, carrying the creasing bars 14 downwardly until the upper portion of the pants becomes taut. Now, the fly bar 34 can be lowered against the fly by activating the cylinder 35; and, the side bars 44 and 45 can be brought in to engage the sides of the pants. This will seal the waist of the pants against the cabinet 10, and also provide side bars 44 and 45 to assist in pressing pocket areas or other side areas of the pants that need particular attention. The cuff clamping means 22 will then be activated to clamp the cuffs of the pants against the creasing bars 12 and 14. With this step, it will be understood that the entire pair of pants is closed off, and sealed against the cabinet 10 of the finishing device. It will be seen in FIG. 2 of the drawings that there is a steam inlet 49. With the pants completely sealed, steam can be ejected from the nozzle 49, and the pants will be filled with steam for overall pressing of the pants.

Figure 3:
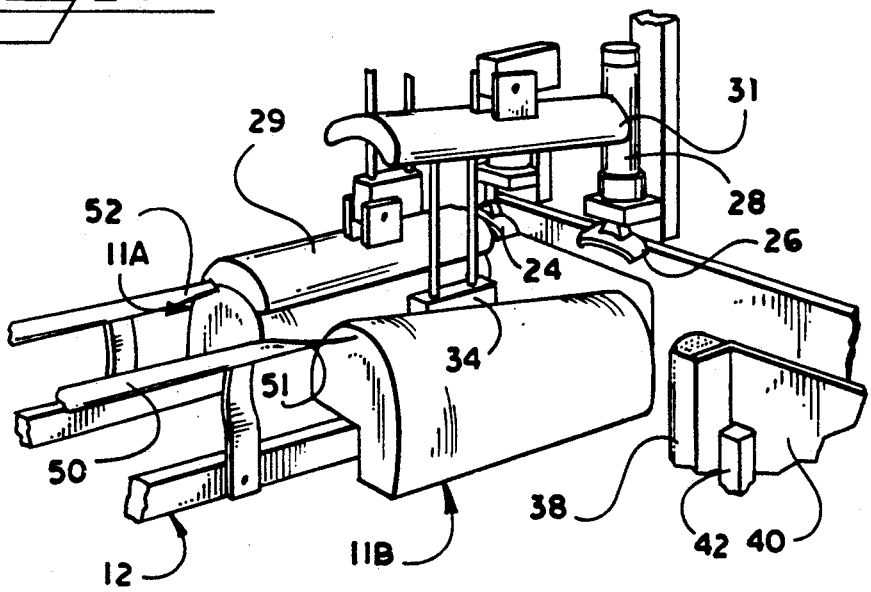
FIG. 3 is a perspective view showing the top finisher of the device in FIG. 1.
Figure 5:
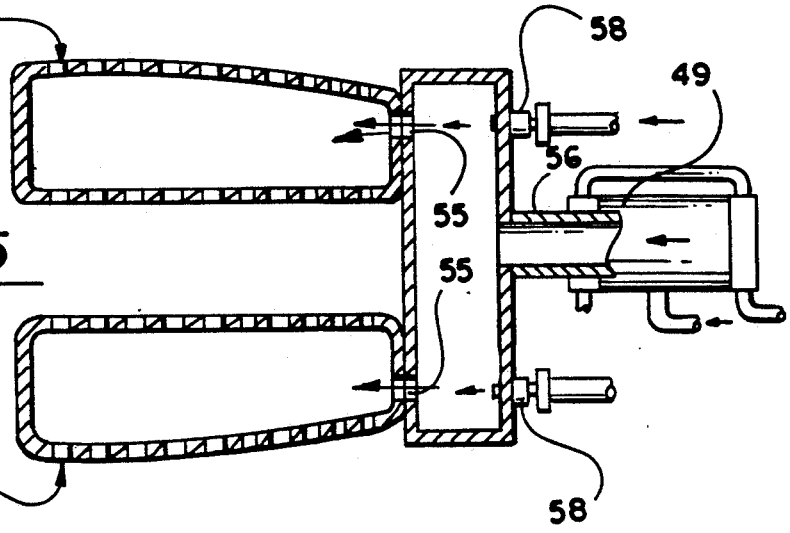
FIG. 5 is a horizontal cross-sectional view taken through the two topping bucks and the manifold for supplying fluid to the bucks.

Attention is next directed to FIGS. 3-5 for a more detailed understanding of the construction and operation of the top pressing means. It should first be realized that the two waist clamps 24 and 26 will preferably operate simultaneously. This allows one to arrange the pants as desired, and push one button to clamp the waist in two places to be sure the pants hold the desired position. Since the pleats must be carefully arranged independently, the pleat plates 29 and 31 are operated independently. FIG. 3 of the drawings shows the pleat plate 31 in raised position and the plate 29 in lowered position. This is for illustration only since no pants are shown in FIG. 3.

Those skilled in the art will realize that the creasing bars 12 and 14 are generally centrally straight bars having reasonably sharp upper and lower edges to provide creases in pants. Looking at the upper creasing bars 12 in FIG. 3 of the drawings, it will be seen that the blades 50 have a straight portion as is known in the art; however, adjacent to the topping bucks 11, the bars twist as indicated at 51 and 52. The right hand bar 50 is twisted clockwise and the left hand bar 50 is twisted counterclockwise. It will now be seen that, with a pair of pants over the topping buck 11B, and the pleat in the pants precisely on the uppermost surface of the topping buck 11B, the pleat will be rolled clockwise, or towards the viewer in FIG. 3. The operator can therefore grasp the fabric of the pants and cause the fabric to wrap around the creasing blade, with the crease aligned with the edge of the twisted portion 51 of the creaser bar 50. This action will automatically cause the pleat throughout the upper portion of the pants to lie over on the buck 11B in position to be pressed. The appropriate valve can then be operated to lower the plate 31 and hold the pleat in the set position. The same steps will be carried out for the left hand pleat, and the plate 29 will be lowered to hold the left hand pleat.

Looking at FIGS. 4 and 5 of the drawings, it will be seen that the topping bucks 11A and 11B are mounted adjacent to a manifold 54, each of the bucks having an interior opening that communicates with the interior of the manifold 54 through an opening 55. Centrally of the manifold 54, there is a vacuum line 56 which is connected to a source of vacuum not here illustrated.

It is also well shown in FIGS. 4 and 5 that the topping bucks 11A and 11B have perforate pressing surfaces. Of course a fabric covering normally covers the entire buck as is well known in the buck pressing art. By operating the vacuum through the vacuum connection 56, it will be understood that the vacuum will assist in causing the pants to adhere to the topping bucks 11A and 11B so the pleats can be held as the plates 29 and 31 are lowered to engage the pleats.

Also connected to the manifold 54, there are two steam lines 58. The steam lines are connected to the rear wall of the manifold 49, and include nozzles that are aligned with the openings 55 into the topping bucks 11A and 11B. Since steam is normally admitted to buck presses under considerable pressure, it has been found that steam released at the rear wall of the manifold 54 will flow across the manifold 54 and enter the bucks 11A and 11B and achieve quite efficient steaming. With this in mind, it will be understood that the top portion of the pants can be carefully positioned with pleats accurately folded and clamped in place. Further, the top portion of the pants can be steamed to do an exceptional finishing job on the top portion of the pants.

FIG. 6 of the drawings shows the control means for the lower creasing blades 14. It has been previously indicated that the plate 48 is carried by the piston rod 60 of the cylinder 46. As is indicated in FIG. 6 of the drawings, the plate 48 has opposed rollers 61 and 62 which engage opposite sides of runners 64. The plate 48 therefore moves up and down on the runners 64 held sturdily by the opposed rollers 61 and 62.

The structure of the plate 48 carries horizontally extending arms 65, the arms 65 mounting a cylinder 66 therebetween. The lower creaser bars 14 are then pivoted to the forward end of the arm 65 at 68, and the piston rod 69 of the cylinder 66 is connected to the rear portion of the creaser bars 14 at 70. It will therefore be seen that, as the piston rod 69 is projected, the creaser bars 14 will be pivoted, causing the left hand end as viewed in FIG. 6 to move downwardly. The purpose of this arrangement is to move the creaser bars 14 downwardly sufficiently to tension the legs in the pants and be sure the best quality crease, and general pressing, are obtained.

It was previously mentioned that, after the pants are carefully placed over the topping bucks 11A and 11B, the plates 48 carrying the lower creaser bars 14 is moved down. This action tensions the waist of the pants and assists in sealing the waist of the pants against the cabinet 10. Those skilled in the art will realize that, with at least some pants, excess tension in the waist will cause distortion of the pants. Thus, it is desirable to have some means to limit the downward movement of the plate 48. The limiting means here shown includes a rod 71 slidably fixed to the carriage carrying the plate 48. This rod 71 extends through a post 72 that is fixed to the top plate of the cabinet 10. A hand screw 74 will fix the rod 71 to the post 72. Thus, the rod 71 will limit the downward motion of the carriage 48, while the carriage 48 is movable upwardly with respect of the rod 71.

FIG. 7 of the drawings shows the side bar operating means. In FIG. 7 it will be seen that the arm 42 includes a pair of rods 75 having a vertical member 76 slidably mounted thereon. The vertical block 76 is appropriately fixed by hand screws 78 so the position of the side bar 45 is variable front to rear of the machine. The rods 75 extend from a plate 79 that carries a cylinder 80. A mounting plate 81 is fixed to the interior of the cabinet 10, the plate 81 having a right angle portion 82 to which the plate 79 is pivoted at 84.

The rods 75 extend through slots 85 in the cabinet 10, and the plates 40 define holes therein for receiving the rods 75. Thus, the arm 42 can move to the left and right as viewed in FIG. 2 of the drawings, the arm 75 moving in the slots 85 while the plates 40 will be carried back and forth with the rods 75. Since the plate 81 is fixed to the cabinet 10, it will be understood that, as the rod of the cylinder 80 is projected, the plates 79 will be caused to pivot with respect to the plate 81 to move the side bar 45 towards the garment. When the rod of the cylinder 80 is retracted, the side bar 45 will move away from the garment. Since the block 76 is movable along the rod 75, and the side bar 45 is pivotal with respect to its carrying arm 86, the arm 86 being pivotal with respect to the block 76, there is considerable variation in the positioning of the side bar 45.

Figure 8:
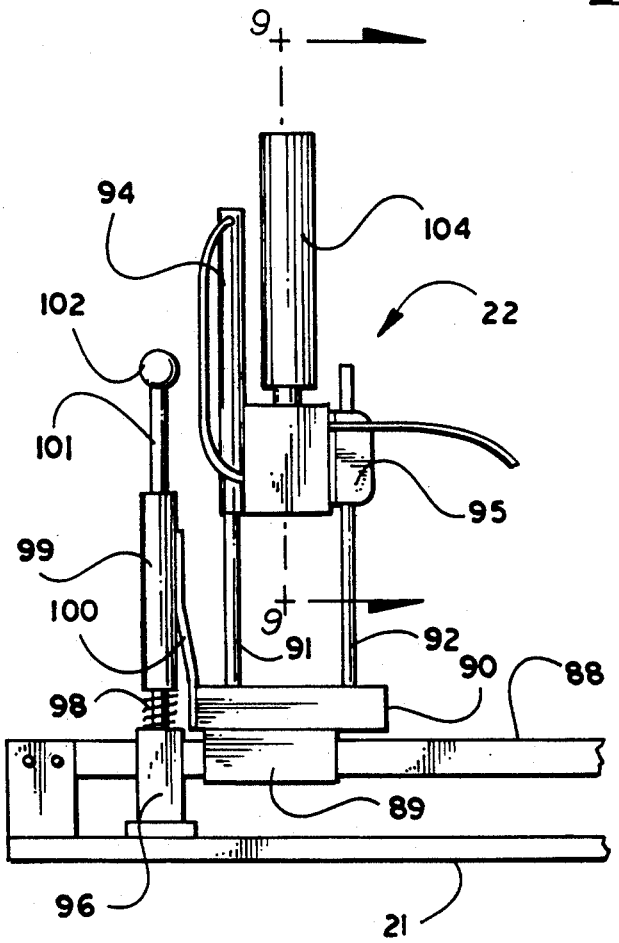
FIG. 8 is an enlarged side elevational view showing the cuff clamps and the controls therefor.
Figure 9:
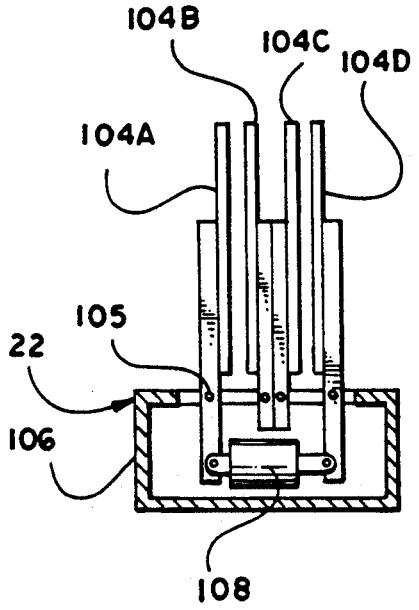
FIG. 9 is a cross-sectional view taken substantially along the line 9—9 in FIG. 8 and illustrating the means for operating the cuff clamps; and, FIG. 10 is a fragmentary side elevational view showing a modified form of the device illustrated in FIG. 1.

FIGS. 8 and 9 of the drawings show the cuff clamp 22 in more detail. FIG. 8 shows the member 21 extending along the floor, and there is a bar 88 above and parallel to the member 21. The cuff clamping assembly 22 is then carried on the bar 88, the clamping assembly 22 including a bearing member 89 that is slidable along the bar 88. The bearing member 89 carries a block 90, and the block 90 supports two rods 91 and 92. The rod 91 is the rod of an air cylinder 94 which is fixed to the assembly 22, while the rod 92 is simply a guide member, a bearing 95 being slidable thereover. Thus, when the air cylinder 94 is caused to retract its rod 91, the clamping assembly will move down to the block 90, and when the air cylinder 94 is caused to project its rod 91, the assembly will move up to the position shown in FIG. 8.

To place the mechanism 22 in the desired location, the bearing member 89 is freely slidable along the bar 88. Such sliding motion is prevented by the foot 96 which acts against the member 21 to hold the assembly in place. The foot 96 is urged downwardly by a spring 98, the spring 98 acting between the foot 96 and a sleeve 99. The sleeve 99 is fixed to the block 90 by the member 100, and the rod 101 is slidable within the sleeve 99, and fixed to the foot 96. Thus, one can grasp the handle 102 fixed to the rod 101 and pull up. This will raise the foot 96 from the member 21, compressing the spring 98. When the handle 102 is released, the spring 98 will urge the foot 96 again in contact with the member 21.

The cuff engaging elements 104 must be openable and closable to engage the cuffs when desired. Looking at FIG. 9 of the drawings, it will be seen that the cuff engaging elements 104 are designated as 104A–D. The elements 104B and 104C are generally vertical, and are generally stationary. The outer elements 104A and 104D are pivotal at 105, and include arms extending into the housing 106. The housing 106 includes an air cylinder 108 that extends between the arms of the members 104A and 104D. Thus, when the rod of the cylinder 108 is projected, the members 104A and 104D will move towards each other, and towards the elements 104B and 104C to clamp cuffs therebetween. When the rod of the cylinder 108 is retracted, the members 104A and 104D will move away from each other to release the cuffs of the pants.

Figure 10:
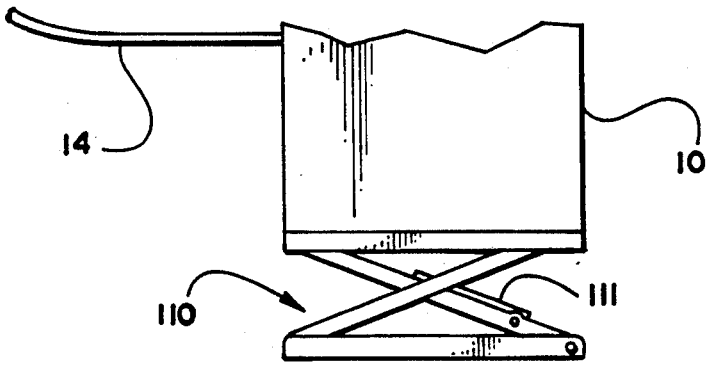

Looking briefly at FIG. 10 of the drawings, those skilled in the art will understand that a finishing device such as that disclosed herein is used most efficiently when the operator is of the appropriate height to reach the machine and the controls therefor. Since one cannot always control the height of the operators, FIG. 10 discloses a means for controlling the height of the machine. For a device such as that shown in FIG. 10, it is contemplated that the cabinet 10 of the machine will be made as short as possible; then, a lift generally designated at 110 is provided to support the machine. Thus, the machine at its lowest position will preferably accommodate the shortest employee or operator that might utilize the machine, and the lift 110 is operable to raise the cabinet 10 to a comfortable height for the tallest of operators.

Lifts such as the lift 110 are well known to those skilled in the art, and no detailed description is thought to be necessary. There is an air cylinder 111 shown to operate the lift 110 in accordance with well known principles.

From the above description, it will be understood that the present invention provides a pants finishing apparatus having a combination of steam finishing with creasing bars, and a buck finishing system for the top portion of the pants. The topping bucks provide means for assisting in careful placement of creases in pants to press the pleats accurately; and, while the pleats of the pants are held, the entire garment is pressed.

With the pants carefully placed on the topping bucks 11A and 11B, and the cuff clamp apparatus 22 in place to close the cuff ends of the pants, steam is injected into the pants by means of the nozzle 49. Also, the cylinder 20 will be activated to raise the rear plate 19 to engage the back of the pants. The back of the pants are therefore also subjected to a buck type pressing operation.

After the garment has been well steamed, the steam will be terminated, and heated air will be blown into the garment. For this purpose, there is a blower 112, here shown in the lower portion of the cabinet 10, the blower having its discharge through a heat exchanger 114. The air will therefore be heated, then directed into the pants held by the apparatus.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In a pants finishing apparatus including a cabinet, a plurality of creasing blades supported by said cabinet, and means for steaming a pair of pants held on said creasing blades, the improvement comprising at least one topping buck supported by said cabinet, one creasing blade of said plurality of creasing blades extending from said at least one topping buck, a pressing plate selectively engageable with said topping buck, and means for introducing steam into said topping buck independent of said means for steaming said pair of pants, and waist clamping means, said waist clamping means including at least one clamping plate selectively engageable with the waist of said pair of pants.

2. The pants finishing apparatus as claimed in claim 1, said pressing plate being selectively engageable with the front of said pair of pants, said apparatus further including a second topping buck carried by said cabinet parallel to said at least one topping buck, and a second pressing plate selectively engageable with said second topping buck for engaging the front of said pair of pants.

3. The pants finishing apparatus as claimed in claim 2, said creasing blades including pleat forming means adjacent to said at least one topping buck and said second topping buck.

4. The pants finishing apparatus as claimed in claim 3, wherein said apparatus includes a fly bar selectively engageable with the fly of said pair of pants.

5. The pants finishing apparatus as claimed in claim 4, comprising a rear plate receivable within said pair of pants against the rear thereof, and a rear pressing plate supported by said cabinet and selectively engageable with the rear of said pair of pants, said rear plate being perforate and having steam passing therethrough.

6. The pants finishing apparatus as claimed in claim 1, said plurality of creasing blades including a pair of upper creasing blades and a pair of lower creasing blades, a carriage for mounting said pair of lower creasing blades, said carriage being vertically movable upwardly for installing said pair of pants and downwardly for tensioning said pair of pants, and including side sealing means engageable with a waist of said pair of pants for sealing said waist to said cabinet.

7. The pants finishing apparatus as claimed in claim 6, comprising cuff clamping means for clamping the cuffs of said pair of pants together, said means for steaming said pair of pants including a steam nozzle within said cabinet for directing steam into said pair of pants held on said plurality of creasing blades.

8. The pants finishing apparatus as claimed in claim 7, including a pair of side bars selectively engageable with side pocket areas of said pair of pants, said pair of bars being movable with said side sealing means.

9. The pants finishing apparatus as claimed in claim 2, including lift means for adjusting a height level of said cabinet.

10. In a pants finishing apparatus including a cabinet, a plurality of creasing blades supported by said cabinet, and means for steaming a pair of pants held on said creasing blades, the improvement comprising lift means for adjusting the height of said cabinet for selectively placing said creasing blades at a preferred height.

11. In a method for finishing a pair of pants wherein said pair of pants is supported on creasing blades and steam is directed into said pair of pants, the improvement including the steps of placing at lest one topping buck in a top portion of said pair of pants, engaging said at least one topping buck with a pressing plate, and passing steam through said at least one topping buck, and subsequently carrying out said step wherein steam is directed into said pair of pants, and wherein said step of placing at lest one topping buck in the top portion of said pair of pants comprises the step of placing a pair of topping bucks in the top portion of said pair of pants, aligning pleats in said pair of pants with the tops of said pair of topping bucks, clamping a waist of said pair of pants to maintain the pleats on the tops of said topping bucks, and applying a vacuum to said pair of topping bucks for holding said pleats against said pair of topping bucks.

12. The method as claimed in claim 11, including engaging said pleats with pressing plates, and subsequently passing steam through said topping bucks while said pleats are engaged with pressing plates.

13. The method as claimed in claim 12, including the step of placing a perforate plate within said pair of pants against rear of said pair of pants, engaging the rear of said pair of pants with a rear pressing plate, and subsequently carrying out said step wherein steam is directed into said pair of pants.

14. The method as claimed in claim 13, including the steps of clamping the cuffs of said pair of pants closed, and subsequently carrying out said step wherein steam is directed into said pair of pants.

15. The method as claimed in claim 14, wherein said creasing blades are moved for tensioning the legs of said pair of pants prior to said step wherein steam is directed into said pair of pants.

16. The method as claimed in claim 15, comprising the steps of terminating said step wherein steam is directed into said pair of pants, and subsequently directing heated air into said pair of pants for setting the creases, and thereafter moving said creasing blades towards one another for releasing said pair of pants.

* * * * *